US012565821B1

(12) United States Patent
Mhaskar et al.

(10) Patent No.: US 12,565,821 B1
(45) Date of Patent: Mar. 3, 2026

(54) MULTICYCLE VALVE SYSTEM AND METHOD

(71) Applicant: Baker Hughes Oilfield Operations LLC, Houston, TX (US)

(72) Inventors: Nauman Mhaskar, Cypress, TX (US); Bryan Blomquist, Spring, TX (US); Zhihui Zhang, Katy, TX (US); Tim Ramsey, The Woodlands, TX (US); Jose Noguera, Spring, TX (US); Bennie Lindsey, The Woodlands, TX (US)

( * ) Notice: Subject to any disclaimer, the term of this patent is extended or adjusted under 35 U.S.C. 154(b) by 0 days.

(21) Appl. No.: 18/907,142

(22) Filed: Oct. 4, 2024

(51) Int. Cl.
*E21B 34/10* (2006.01)
*E21B 34/14* (2006.01)

(52) U.S. Cl.
CPC ..... *E21B 34/142* (2020.05); *E21B 34/10* (2013.01); *E21B 2200/04* (2020.05); *E21B 2200/06* (2020.05)

(58) Field of Classification Search
CPC .... E21B 34/142; E21B 34/10; E21B 2200/04; E21B 2200/06
USPC ..... 166/373
See application file for complete search history.

(56) References Cited

U.S. PATENT DOCUMENTS 10,221,643 B2 3/2019 Zhang et al.
10,253,590 B2 4/2019 Xu et al.
10,364,630 B2 7/2019 Xu et al.
10,450,840 B2 10/2019 Xu
11,686,196 B2 * 6/2023 Ramasamy ..... E21B 44/005 166/250.01
2014/0345875 A1 * 11/2014 Murphree ..... C09K 8/518 507/202
2014/0345878 A1 11/2014 Murphree
(Continued)

FOREIGN PATENT DOCUMENTS

WO 2014189766 A2 11/2014
WO 2017100417 A1 6/2017
(Continued)

OTHER PUBLICATIONS

Notification of Transmittal of the International Search Report and the Written Opinion of the International Searching Authority, or the Declaration; PCT/US2025/046288; Mail date: Nov. 14, 2025; 9 pages.

*Primary Examiner* — Nicole Coy
*Assistant Examiner* — Douglas S Wood
(74) *Attorney, Agent, or Firm* — Baker Hughes Company

(57) ABSTRACT

A multicycle valve system, including a housing, a port extending radially through the housing, a movable closure to change a condition of the port, a seat connected to the movable closure, a biaser between the housing and the closure, and a DoD object, an igniter in contact with the disappear on demand material, and a signal receiver in communication with the igniter. A method for operating a multicyclic valve system including landing an object on a seat, moving a closure by loading the object, deforming a biaser upon moving the closure, changing a condition of a port with the the closure, rendering the object incapable of remaining on the seat, and returning the closure to a position prior to moving with the biaser. A borehole system including a borehole, a string in the borehole, and a multicycle valve system as claimed disposed within or as a part of the string.

14 Claims, 2 Drawing Sheets

(56) References Cited

U.S. PATENT DOCUMENTS

| | | | | |
|---|---|---|---|---|
| 2015/0114664 | A1* | 4/2015 | Hulsewe | E21B 34/10 166/373 |
| 2016/0186514 | A1* | 6/2016 | King | E21B 34/102 166/250.01 |
| 2016/0201432 | A1* | 7/2016 | Holcomb | E21B 34/12 166/250.01 |
| 2018/0171737 | A1* | 6/2018 | Xu | E21B 29/02 |

FOREIGN PATENT DOCUMENTS

| | | | |
|---|---|---|---|
| WO | 2018118296 | A1 | 6/2018 |
| WO | 2019099098 | A1 | 5/2019 |

* cited by examiner

MULTICYCLE VALVE SYSTEM AND METHOD

BACKGROUND

In the resource recovery and fluid sequestration industries dropped objects are often used to actuate a valve system to allow, for example, a fracturing operation or similar to take place by landing the object on a seat to open a fluid flow pathway. Such systems work well for single actuations but generally employ different sized seats and objects for systems in which multiple actuations are required. The systems are each one time actuations and generally include separately actuated closing valves to reclose the open fluid pathway. The art is always receptive to innovation that increases efficiency.

SUMMARY

An embodiment of a multicycle valve system, including a housing, a port extending radially through the housing, a movable closure positionable to change a flow condition of the port, an object seat operably connected to the movable closure, a biaser disposed between the housing and the movable closure, and an object including a disappear-on-demand material, an igniter in operable contact with the disappear on demand material, and a signal receiver in operable communication with the igniter.

An embodiment of a method for operating a multicyclic valve system including landing an object on a seat in the system, moving a closure of the system by loading the object, deforming a biaser of the system upon moving the closure, changing a flow condition of a port with the moving of the closure, rendering the object incapable of remaining on the seat, and returning the closure to a position prior to moving with the biaser.

An embodiment of a borehole system including a borehole in a subsurface formation, a string in the borehole, and a multicycle valve system disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
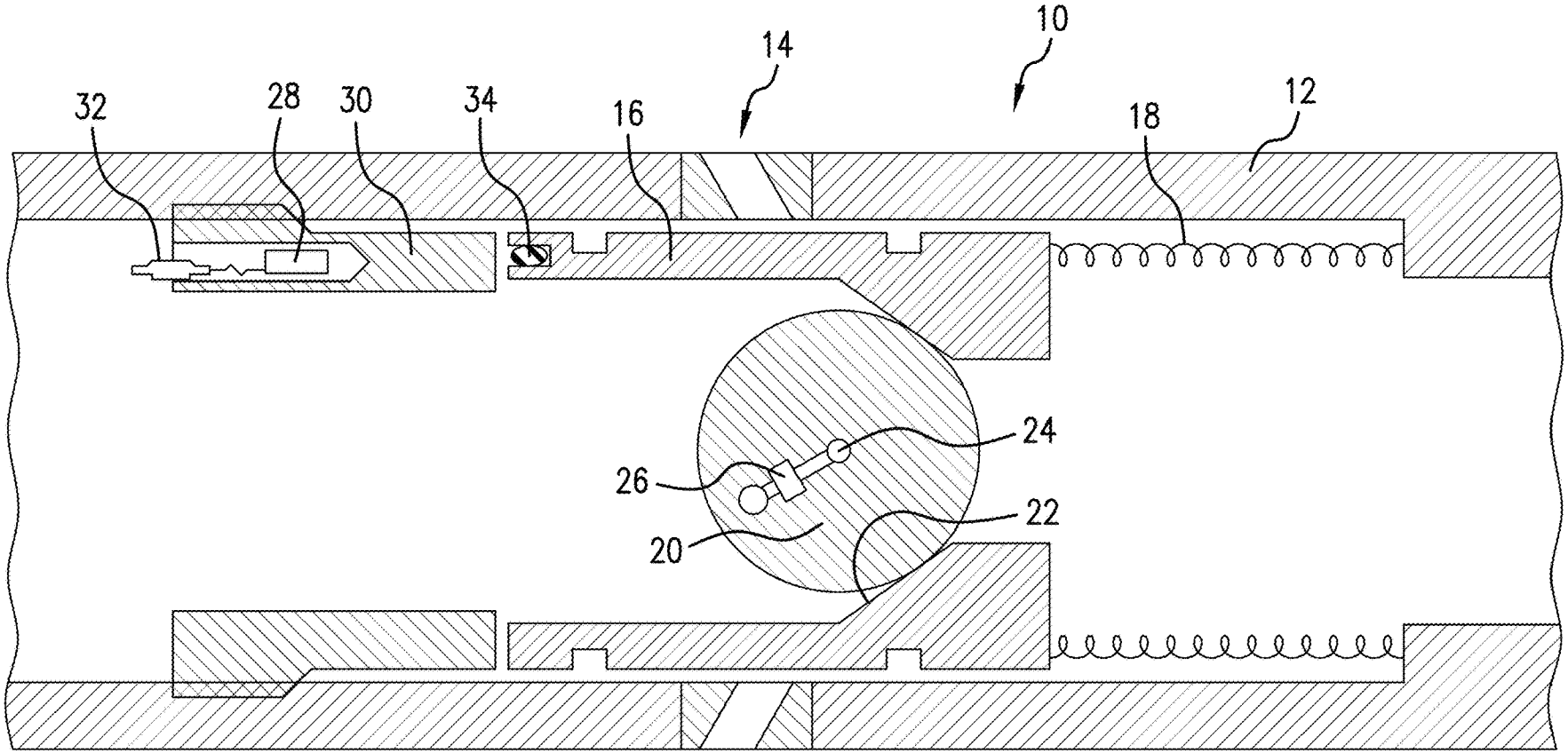
FIG. 1 is a schematic cross section view of a multicyclic valve system as disclosed herein.

Referring to FIG. 1, a multicyclic valve system 10 is illustrated that improves efficiency for a well operator by supporting multicyclic operation of a valve that is responsive to a dropped object. System 10 includes a housing 12 having a port 14 extending radially through the housing 12. In embodiments, the port 14 may comprise an erosion resistant material in the form of a coating or portion of the port 14 or as an insert. In embodiments, the erosion resistance may be provided in any of the configurations by a carbide material, for example. A movable closure 16, illustrated as a sleeve though other configurations are contemplated such as non-annular members, etc., is disposed within the housing 12 and is positionable to change a flow condition of the port 14. Specifically, the closure 16 may be positioned so that movement of the closure 16 will be from a closed position of the port to an open position of the port or from an open position of the port to a closed position of the port. This simply depends upon where the closure 16 is initially located relative to the port 14 and direction of movement of the closure 16. In FIG. 1, the system 10 is illustrated such that the port 14 is closed prior to actuation of the closure 16 and that movement of the closure 16 will change the flow condition of the port 14 to an open condition.

A biaser 18 is disposed between the housing 12 and the movable closure 16 to bias the closure 16 to an initial position relative to the flow condition of the port 14. Specifically, the closure 16 may be in a position initially, e.g. a run in position where the closure 16 obstructs the port 14 and can be moved by an input against the impetus of the biaser 18 to a position that is less of an obstruction to the port 14 or no obstruction to the port 14. Reduction in the input force that moves the closure 16 in the first place allows the biaser 18 to return the closure 16 to the initial port closed position. Alternatively, the closure 16 may be in a position initially, e.g. a run in position where the closure 16 does not obstruct the port 14 and can be moved against the impetus of the biaser 18 to a position that is more of an obstruction to the port 14 or to a full obstruction of the port 14, while allowing the biaser 18 to return the closure 16 to the initial port open position when the input that moves the closure 16 in the first place is removed. Because of the action of the biaser 18 to essentially reset the closure 16, the valve is multicyclic.

The input alluded to above is provided by an object 20 dropped from a surface location or supplied from other remote location and allowed to fall or be conveyed fluidically to a seat 22 operably connected to the movable closure 16 (and applied pressure). In some embodiments, the seat 22 is a portion of the closure 16. Object 20, which may be a ball, dart, etc., is geometrically configured to seal or substantially seal on the seat 22 thereby supporting a significant pressure differential across the seat 22 when pressure is applied to the system 10, usually from surface. The result of the pressure acting on the object 20 is that the movable closure 16 will move and deform the biaser 18 thereby converting kinetic energy to potential energy in the biaser that can later be used to move the closure 16 back to an initial position when the applied pressure is removed. FIG. 1 illustrates the biaser 18 as a compression coil spring but it is to be appreciated that other types of arrangements that have similar effect such as gas springs, oppositely polarized magnetic arrangements, etc. may be substituted. Further, while the illustrated biaser 18 is configured for compression in response to applied pressure, the system 10 could easily be configured for the biaser 18 to be in tension in response to the applied pressure by positioning the biaser 18 on an end of closure 16 opposite to that illustrated.

In order to support the multicyclic nature of the system 10, the object 20 includes a disappear-on-demand (DoD) material. The material may make up a portion of the object 20 or may make up all of the object 20. The DoD material is available commercially from Baker Hughes and comprises a matrix that includes an energetic material. The DoD material is one that does not require particular to fluids in the borehole (naturally occurring or added) to degrade but rather will respond to a specific trigger such as a wireless electromagnetic signal, acoustic signal, seismic signal, etc.

whereby an igniter is signaled to ignite (discussed further below). This is not to mean, however, that an additional material that is degradable by exposure to fluids in the borehole (such as Baker Hughes Intallic™ corrodible electrolytic material) cannot be combined with the DoD or used alongside the DoD in the object 20. The matrix comprises a polymer, a metal, a composite, or a combination comprising at least one of the foregoing, which provides the general material properties such as strength, ductility, hardness, density for tool functions. Exemplary matrix materials comprise matrix polymers that may include at least one of an epoxy, a phenolic resin, an epoxy phenolic resin, a vinyl ester, a polybismaleimide, a cyanate ester, or a polyester. Choices for an epoxy matrix can include polymerizing at least one of an aliphatic epoxide such as butanediol diglycidyl ether, a bisphenol epoxide such as bisphenol-A diglycidyl ether (CAS #1675-54-3) and/or bisphenol-F diglycidyl ether, or a novolac epoxide such as phenol-formaldehyde polymer glycidyl ether (CAS #28064-14-4). In an aspect, the epoxy contains a polymerized diglycidylether of a bisphenol wherein the number of the repeating units of the epoxy resin range from 0 to 18, preferably 0 to less than 2.5. The curing agent includes an active group that can react with an epoxy group. Examples of such an active group include amino groups and acid anhydride groups. In an aspect the curing agent is at least one of an aliphatic amine or an aromatic amine. Choices for a phenolic matrix can be produced from the polymerization of a phenol ($C_6H_5OH$), an alkyl-substituted phenol, a halogen-substituted phenol, or a combination thereof, and a formaldehyde compound such as formaldehyde ($CH_2C{=}O$). An epoxy phenolic matrix is phenolic resin modified at the phenolic hydroxyl group to include an epoxide functional group such as $—CH_2—(C_2H_3O)$, where $—(C_2H_3O)$ is a three-membered epoxide ring. A vinyl ester (vinyl acetate) matrix is a resin produced by the esterification of an epoxy resin with acrylic or methacrylic acids. The polybismaleimide can be synthesized by condensation of phthalic anhydride with an aromatic diamine, which yields bismaleimide such as 4,4'-bismaleimidodiphenylmethane, followed by subsequent Michael addition of more diamine to the double bond at the ends of the bismaleimide. The monomer bismaleimide can also be copolymerized with vinyl and allyl compounds, allyl phenols, isocyanates, aromatic amines, or a combination thereof. Cyanate esters are compounds generally based on a phenol or a novolac derivative, in which the hydrogen atom of the phenolic OH group is substituted by a cyanide group (—OCN). Suitable cyanate esters include those described in U.S. Pat. No. 6,245,841 and EP 0396383. Cyanate esters can be cured and postcured by heating, either alone, or in the presence of a catalyst. Curing normally occurs via cyclotrimerization (an addition process) of three CN groups to form three-dimensional networks comprising triazine rings. The polyester can be formed by the reaction of a dibasic organic acid and a dihydric alcohol. Choices for a polyester matrix can include orthophthalic polyesters that are made by phthalic anhydride with either maleic anhydride or fumaric acid, or isophthalic polyesters that are made from isophthalic acid or terephthalic acid.

Optionally, a reinforcing fiber can be used to increase the tensile strength and the compressive strength of the material. The reinforcing fiber can comprise one of carbon fiber, glass fiber, polyethylene fiber, or aramid fiber. The form of the reinforcing fiber can include continuous fibers or short fibers. Continuous fibers can be disposed within the degradable article along a reinforcing direction, providing a continuous path for load bearing, while short fibers can be blended into the polymer matrix in a random or semi-random orientation. Short fibers can include staple fibers, chopped fibers, or whiskers. Staple fibers typically have a lengths of about 10 to about 400 mm. Chopped fibers can have a lengths of about 3 to about 50 mm while whiskers are a few millimeters length. Combinations of the fibers in different forms and different compositions can be used. Exemplary continuous fiber composite can have a tensile strength of about 40 to about 50 kilopound per square inch (ksi). Exemplary short fiber composite can have a compressive strength of about 25 to about 40 ksi.

Optionally, the matrix material further comprises additives such as carbides, nitrides, oxides, precipitates, dispersoids, glasses, carbons, excess metal/metal alloy that does not participate in an oxidation-reduction reaction or the like in order to control the mechanical strength and density of the degradable article.

The energetic material may comprise a thermite, a reactive multi-layer foil, an energetic polymer, or a combination comprising at least one of the foregoing. Use of energetic materials disclosed herein is advantageous as these energetic materials are stable at wellbore temperatures but produce an extremely intense exothermic reaction following activation, which facilitates the rapid disintegration of the disintegrable articles. Additionally, the matrix material may be the energetic material.

Thermite compositions can include, for example, a metal powder (a reducing agent) and a metal oxide (an oxidizing agent) that produces an exothermic oxidation-reduction reaction known as a thermite reaction. Choices for a reducing agent include aluminum, magnesium, calcium, titanium, zinc, silicon, boron, and combinations including at least one of the foregoing, for example, while choices for an oxidizing agent include boron oxide, silicon oxide, chromium oxide, manganese oxide, iron oxide, copper oxide, lead oxide, and combinations including at least one of the foregoing, for example.

Energetic polymers are materials possessing reactive groups, which are capable of absorbing and dissipating energy. During the activation of energetic polymers, energy absorbed by the energetic polymers cause the reactive groups on the energetic polymers, such as azido and nitro groups, to decompose releasing gas along with the dissipation of absorbed energy and/or the dissipation of the energy generated by the decomposition of the active groups. The heat and gas released promote the disintegration of the disintegrable articles.

Energetic polymers include polymers with azide, nitro, nitrate, nitroso, nitramine, oxetane, triazole, or tetrazole containing groups. Polymers or co-polymers containing other energetic nitrogen containing groups can also be used. Optionally, the energetic polymers further include fluoro groups such as fluoroalkyl groups.

Exemplary energetic polymers include nitrocellulose, azidocellulose, polysulfide, polyurethane, poly glycidyl ether, a fluoropolymer combined with nano particles of combusting metal fuels, polybutadiene; polyglycidyl nitrate such as polyGLYN, butanetriol trinitrate, glycidyl azide polymer (GAP), for example, linear or branched GAP, GAP diol, or GAP triol, poly [3-nitratomethyl-3-methyl oxetane](polyNIMMO), poly(3,3-bis-(azidomethyl)oxetane (polyBAMO) and poly(3-azidomethyl-3-methyl oxetane) (polyAMMO), polyvinylnitrate, polynitrophenylene, nitramine polyethers, or a combination comprising at least one of the foregoing.

The reactive multi-layer foil can comprise aluminum layers and nickel layers. The reactive multi-layer foil can also comprise titanium layers and boron carbide layers. In specific embodiments, the reactive multi-layer foil includes alternating aluminum and nickel layers. Further information can be obtained by review of U.S. Pat. No. 10,450,840, which is incorporated herein by reference in its entirety.

Further included in the object 20 is an igniter 24 that is in operable contact with the DoD material. In this case, the operable contact means that the igniter when ignited is capable of causing initiation of a thermal decomposition of the DoD material of the object 20. Upon thermal decomposition the intended result is that the object 20 will no longer be seated in the seat 22. Without the object 20 on the seat 22, the biaser 18 will take over and return the seat 22 and hence the closure 16 to its initial run in position. This result can be obtained as long as the object no longer has a geometry capable of seating on the seat 22. This can be because the object is completely dissolved or degraded to essentially a powder or ash, or can occur where pieces left of the object 20 are simply too small to span the seat 22 and therefore fall through the seat with gravity or fluid flow.

The igniter 24 is operated by a signal such as a wireless electromagnetic signal, acoustic signal, seismic signal, etc. whereby the igniter is signaled to ignite. Such a signal is received at a signal receiver 26 on or in the object 20. The receiver 26 may also be a transceiver if additional feedback of an ignition is desired other than the change in flow that will occur in response to the ignition of the DoD material. A transmitter 28 for the system 10 may be located in or near the system 10 such as in a transmitter sub 30 as illustrated so that a wired-type connection 32 to a remote control location (e.g. surface) may be used or the transmitter 28 may be located more remotely from the object 20. Where a transmitter sub 30 is used, it may also be configured with a location indicator 34 to help determine a position of the closure 16 in real time, in embodiments. The indicator 34 may be operably connected to the transmitter 28 for communication purposes.

Having discussed the composition of the DoD material, it is well to also note that such material is highly exothermic during decomposition and hence consideration of temperatures associated with such decomposition is desirable. Specifically, the seat 22 may be configured with a ceramic or other high temperature material coating, overlay or insert to protect the seat 22 from thermal degradation.

With the system 10 as described, one may drop an object 20 to land on the seat 22 at will and open the port 14 or close the port 14 depending upon which way the system 10 is configured and then reverse the process by sending a signal to the receiver 26 to ignite the igniter 14 and thermally decompose at least portions of the object 20, whereafter the biaser 18 will reset the valve system 10.

Figure 2:
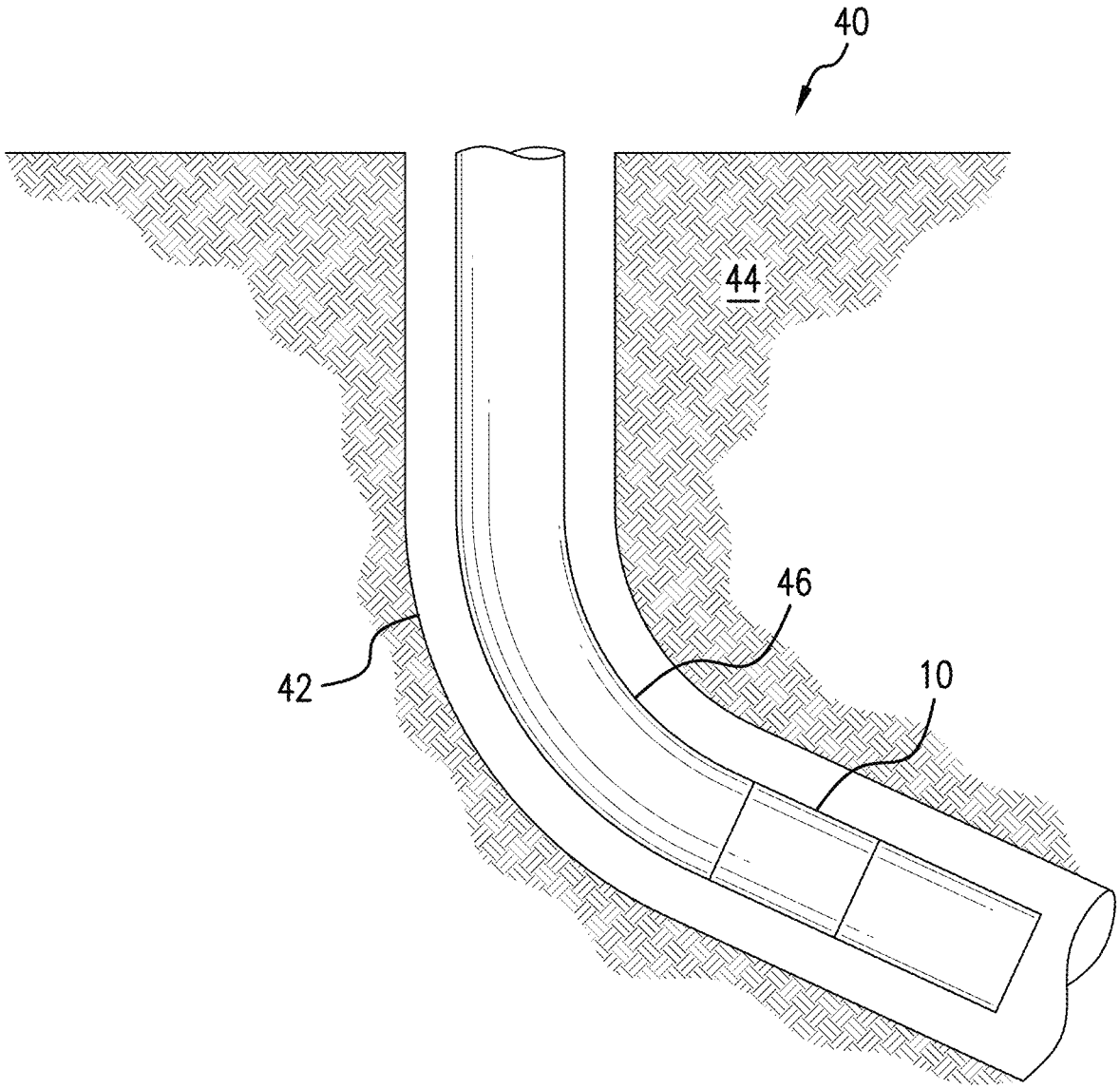
FIG. 2 is a view of a borehole system including multicyclic valve system as disclosed herein.

Referring to FIG. 2, a borehole system 40 is illustrated. The system 40 comprises a borehole 42 in a subsurface formation 44. A string 46 is disposed within the borehole 42. A multicycle valve system 10 as disclosed herein is disposed within or as a part of the string 46.

Set forth below are some embodiments of the foregoing disclosure:

Embodiment 1: A multicycle valve system, including a housing, a port extending radially through the housing, a movable closure positionable to change a flow condition of the port, an object seat operably connected to the movable closure, a biaser disposed between the housing and the movable closure, and an object including a disappear-on-demand material, an igniter in operable contact with the disappear on demand material, and a signal receiver in operable communication with the igniter.

Embodiment 2: The system as in any prior embodiment, further including a transmitter in operable communication with the igniter.

Embodiment 3: The system as in any prior embodiment, wherein the transmitter is within the housing.

Embodiment 4: The system as in any prior embodiment, wherein the transmitter is disposed in a transmitter sub disposed within the housing.

Embodiment 5: The system as in any prior embodiment, wherein the port includes an erosion resistant surface.

Embodiment 6: The system as in any prior embodiment, wherein the movable closure is a sleeve slidably disposed in the housing.

Embodiment 7: The system as in any prior embodiment, wherein the biaser is a coil spring.

Embodiment 8: A method for operating a multicyclic valve system including landing an object on a seat in the system, moving a closure of the system by loading the object, deforming a biaser of the system upon moving the closure, changing a flow condition of a port with the moving of the closure, rendering the object incapable of remaining on the seat, and returning the closure to a position prior to moving with the biaser.

Embodiment 9: The method as in any prior embodiment, wherein the rendering is by degrading the object upon receipt of a signal.

Embodiment 10: The method as in any prior embodiment, wherein the degrading is disappearing-on-demand.

Embodiment 11: The method as in any prior embodiment, wherein the signal is a wireless electromagnetic signal.

Embodiment 12: The method as in any prior embodiment, wherein the signal is a wireless acoustic signal.

Embodiment 13: The method as in any prior embodiment, wherein the rendering includes igniting an igniter upon receipt of the signal.

Embodiment 14: The method as in any prior embodiment, wherein the rendering includes thermally decomposing the object.

Embodiment 15: The method as in any prior embodiment, wherein the changing of flow condition is opening.

Embodiment 16: The method as in any prior embodiment, wherein the changing of flow condition is closing.

Embodiment 17: A borehole system including a borehole in a subsurface formation, a string in the borehole, and a multicycle valve system as claimed in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semisolids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A multicycle valve system, comprising:
- a housing;
- a port extending radially through the housing;
- a repeatably movable closure positionable to change a flow condition of the port;
- an object seat operably connected to the movable closure;
- a biaser disposed between the housing and the movable closure and configured to close the closure;
- an object including a disappear-on-demand material, an igniter disposed in physical contact with the object, the igniter in operable contact with the disappear on demand material, and a signal receiver in operable communication with the igniter;
- a transmitter disposed within the housing and in operable communication with the igniter; and
- a location indicator disposed to indicate a position of the closure.

2. The system as claimed in claim 1, wherein the transmitter is disposed in a transmitter sub disposed within the housing.

3. The system as claimed in claim 1, wherein the port includes an erosion resistant surface.

4. The system as claimed in claim 1, wherein the movable closure is a sleeve slidably disposed in the housing.

5. The system as claimed in claim 1, wherein the biaser is a coil spring.

6. A borehole system comprising:
- a borehole in a subsurface formation;
- a string in the borehole; and
- a multicycle valve system as claimed in claim 1 disposed within or as a part of the string.

7. A method for operating a multicyclic valve system comprising:
- landing an object on a seat in the system;
- moving a closure of the system by loading the object;
- deforming a biaser of the system upon moving the closure;
- changing a flow condition of a port with the moving of the closure;
- rendering the object incapable of remaining on the seat with a signal sent to the object from the housing;
- returning the closure to a position prior to moving with the biaser such that subsequent action is repeatable; and
- monitoring a position of the closure with a location indicator.

8. The method as claimed in claim 7, wherein the degrading is disappearing-on-demand.

9. The method as claimed in claim 7, wherein the signal is a wireless electromagnetic signal.

10. The method as claimed in claim 7, wherein the signal is a wireless acoustic signal.

11. The method as claimed in claim 7, wherein the rendering includes igniting an igniter upon receipt of the signal.

12. The method as claimed in claim 7, wherein the rendering includes thermally decomposing the object.

13. The method as claimed in claim 7, wherein the changing of flow condition is opening.

14. The method as claimed in claim 7, wherein the changing of flow condition is closing.

* * * * *